US005540756A

United States Patent [19]

Hoppitt et al.

[11] Patent Number: 5,540,756

[45] Date of Patent: Jul. 30, 1996

[54] ELECTROSTATIC FILTER AND METHOD OF FILTERING DUST

[76] Inventors: Bernard Hoppitt, c/o Interfilta Limited, Rossendale Road Trading Estate, Farringdon Road, Burnley, Lancashire BB11 5SY, Great Britain; Bo Engvall, c/o Scanfilter A.B., P.O. Box 202, 51201 Svenljunga, Sweden

[21] Appl. No.: 400,307

[22] Filed: Mar. 6, 1995

Related U.S. Application Data

[63] Continuation of Ser. No. 924,010, filed as PCT/GB91/00423, Mar. 19, 1991 published as WO91/14503, Oct. 1991, abandoned.

[30] Foreign Application Priority Data

Mar. 19, 1990 [GB] United Kingdom ..... 9006146

[51] Int. Cl.[6] ..... B03C 3/011

[52] U.S. Cl. ..... 95/69; 55/486; 55/528; 55/DIG. 39; 96/57; 96/68

[58] Field of Search ..... 55/486, 487, 521, 55/524, 527, 528, DIG. 39; 428/286, 287; 307/400; 95/69, 70; 96/17, 57, 58, 68

[56] References Cited

U.S. PATENT DOCUMENTS

| | | | |
|---|---|---|---|
| 4,215,682 | 8/1980 | Kubik et al. | 55/528 X |
| 4,323,374 | 4/1982 | Shinagawa et al. | 55/486 X |
| 4,376,642 | 3/1983 | Verity | 55/279 X |
| 4,626,263 | 12/1986 | Inoue et al. | 55/DIG. 39 |
| 4,824,451 | 4/1989 | Vogt et al. | 55/528 |
| 4,880,448 | 11/1989 | Scherrer | 55/486 X |
| 4,886,527 | 12/1989 | Fottinger et al. | 55/487 X |
| 4,902,449 | 2/1990 | Hobbs | 55/524 x |
| 4,917,714 | 4/1990 | Kinsley, Jr. | 55/528 X |
| 4,917,942 | 4/1990 | Winters | 55/486 X |
| 4,983,192 | 1/1991 | von Blucher et al. | 55/528 X |

FOREIGN PATENT DOCUMENTS

| | | | |
|---|---|---|---|
| 038743 | 10/1981 | France . | |
| 2048110 | 12/1980 | United Kingdom . | |
| 2190689 | 11/1987 | United Kingdom | 96/68 |

OTHER PUBLICATIONS

Lunenschlob et al., "Bonded Fibre Fabrics", Georg Thieme Verlag Stuttgart, New York, 1982, pp. 1–13.

Lunenschlob et al, "Vliesstoffe", Georg Thieme Verlag Stuttgart, New York, 1982, pp. 310–316.

*Primary Examiner*—Richard L. Chiesa

*Attorney, Agent, or Firm*—Caesar, Rivise, Bernstein, Cohen & Pokotilow, Ltd.

[57] ABSTRACT

An electrostatic filter of a combination of a layer of filter material having electrostatic properties and a layer of filter medium without electrostatic properties. The medium is a lofted material arranged to retain particles in the sub-micron and lower micron ranges, and in use, is located upstream of the material. The invention also includes a method of filtering dust from the atmosphere utilizing the electrostatic filter.

7 Claims, 1 Drawing Sheet

ELECTROSTATIC FILTER AND METHOD OF FILTERING DUST

This application is a continuation of application Ser. No. 07/924,010, filed as PCT/GB91/00423, Mar. 19, 1991, published as WO91/14503, Oct. 3, 1991. now abandoned.

FIELD OF THE INVENTION

The invention relates to a filter and in particular to one including a filter material having electrostatic properties.

BACKGROUND OF THE INVENTION

It has been observed that with time the electrostatic properties of a filter material having such properties tends to deteriorate. It has been proposed to locate a second finer filter medium downstream of the electrostatic filter material to ensure that the filter continues to function even when the filtering properties of the electrostatic filter material fall away. It has now been discovered that if a filter medium is located upstream of the electrostatic filter material the electrostatic properties tend to be maintained.

SUMMARY OF THE INVENTION

According to the invention in one aspect there is provided a filter comprising the combination of a filter material having electrostatic properties and a filter medium without electrostatic properties; the medium being lofted material arranged to retain particles in the sub-micron and lower micron ranges and, in use, being located upstream of the material.

DESCRIPTION OF THE DRAWING

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENT

Figure 1:
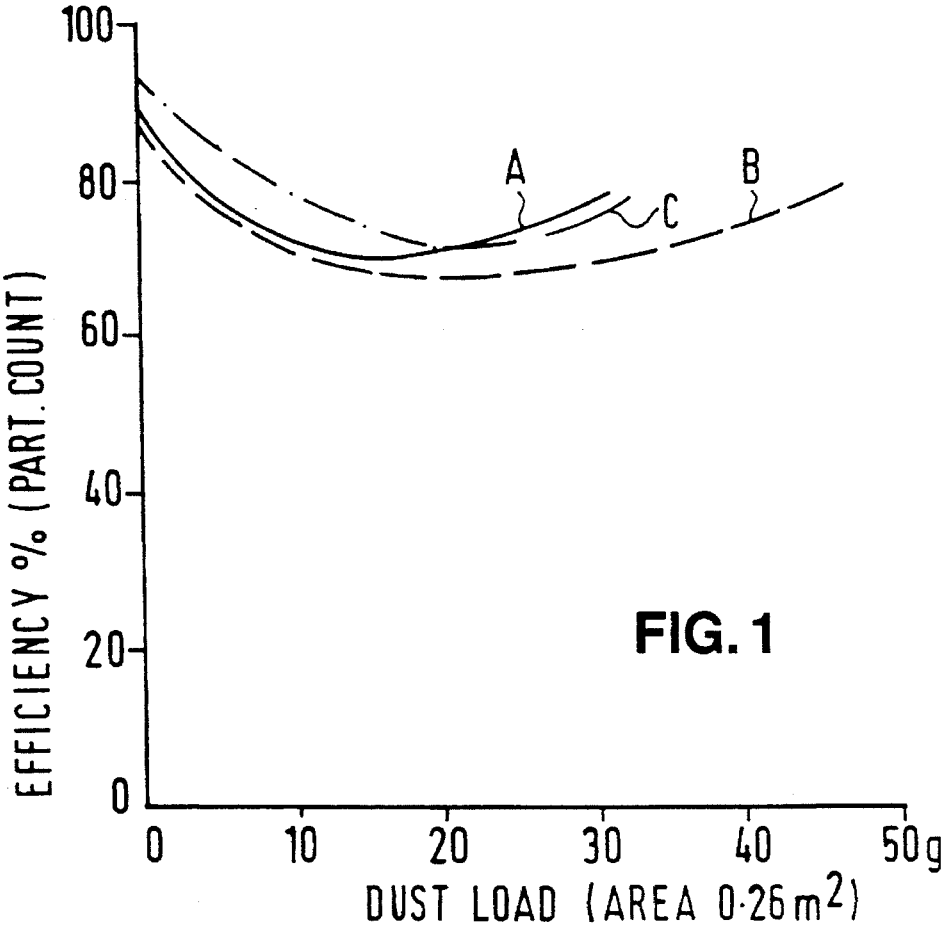
FIG. 1 is a graph showing the load of dust taken up by the different filters.

While we do not wish the scope of the invention to be limited by the following theory, our studies suggest that the deterioration in electrostatic effect is contributed to by the entrapment of loose particles in the sub-micron and lower micron ranges in the electrostatic filter material and that if a significant number of such particles can be isolated from the filter material the electrostatic effect will remain substantially constant. The presence of the filter medium upstream in the air flow entraps particles which could contribute to the deterioration.

The upstream filter medium is preferably constructed in such a manner that it increases in efficiency during or throughout its life. The rate of increase is preferably arranged such that should there be any eventual reduction in the electrostatic properties of the electrostatically charged material, this will be covered or compensated by the increase in the mechanical collection efficiency of the upstream medium to the point where no loss in overall efficiency of the filter occurs.

The filter material having electrostatic properties may be selected from a wide variety of such materials. It is preferred that the material comprise a blend, e.g. a felt, of clean polyolefin fibres and clean fibres of an addition polymer comprising one or more halogen-substituted hydrocarbons. Such blends are described and claimed in the GB patent 2190689, the entire disclosure of which is to be incorporated herein merely by this reference. Other blends which could be used are: polypropylene and cellulose diacetate; polypropylene and stainless steel; polypropylene and cotton; polypropylene and silk; and polypropylene and wool; nylon and polypropylene; and polypropylene and polyethylene.

The filter medium without electrostatic properties may be any such medium having the ability to capture dust or like particles in the determined range. The filter medium may be formed in known manner and or known materials; typically it will be formed of a blend of known fibres, e.g., synthetic fibres. In an example a prefilter layer was manufactured utilizing polyester/polyamide/polypropylene fibre carded to form a fleece, but without any electrostatic charge and the material had a density of approx. 110–160 g/m$^2$. The filter medium will tend to provide mechanical support to the electrostatic filter material if the two are in close side-by-side relation.

According to the invention in another aspect there is provided a method of filtering dust from a dust containing atmosphere, the method of comprising passing the atmosphere through a filter comprising a filter material having electrostatic properties and a lofted filter medium without electrostatic properties, the medium being located upstream of the filter material and arranged to retain particles including those in the sub-micron and lower micron ranges.

A filter of the invention may be used in a wide variety of industrial application such as air conditioning units, suction cleaners, helmets, respirators and so on.

In order that the invention may be well understood it will now be described by way of illustration with reference to the following examples and the graphs of the accompanying drawing. Parts are by weight unless otherwise specified.

EXAMPLES

Clean crimped polypropylene fibre and clean crimped modacrylic fibre were mixed together. An electrodet filter material was produced by a process in which the mixture was carded to form a fleece until the fibres acquired an electric charge. The fleece was needled to form a felt, which was the electrostatic filter material. The felt was 7–10 mm thick and had a density of about 160–220 g/m$^2$.

A prefilter layer was manufactured by carding polyester/polyamide/polypropylene fibre carded to form a fleece, but without any electrostatic charge. The fleece was cross laid and then processed in a curing oven to bond the interstices between the fibres together, producing a lofted pre-filter material having a density greater than about 110 g/m$^2$, e.g. of approximately 130–140 g/m$^2$.

The preferred process utilizes bi-component fibres including high and low melt temperature components such that the low melt temperatures fibres become tacky in the curing oven, so bonding the fibres together their interstices. In alternative processes a bonding agent may be applied as a liquid spray or a powder dusting.

The prefilter and the electrostatic filter material were laid alongside each other and the multi-layer product was mounted in a filter apparatus therefore, the prefilter being towards the inlet or upstream end, to form a filter embodying the invention. The layers may additionally be physically bonded together by needling or other methods of bonding.

Figure 2:
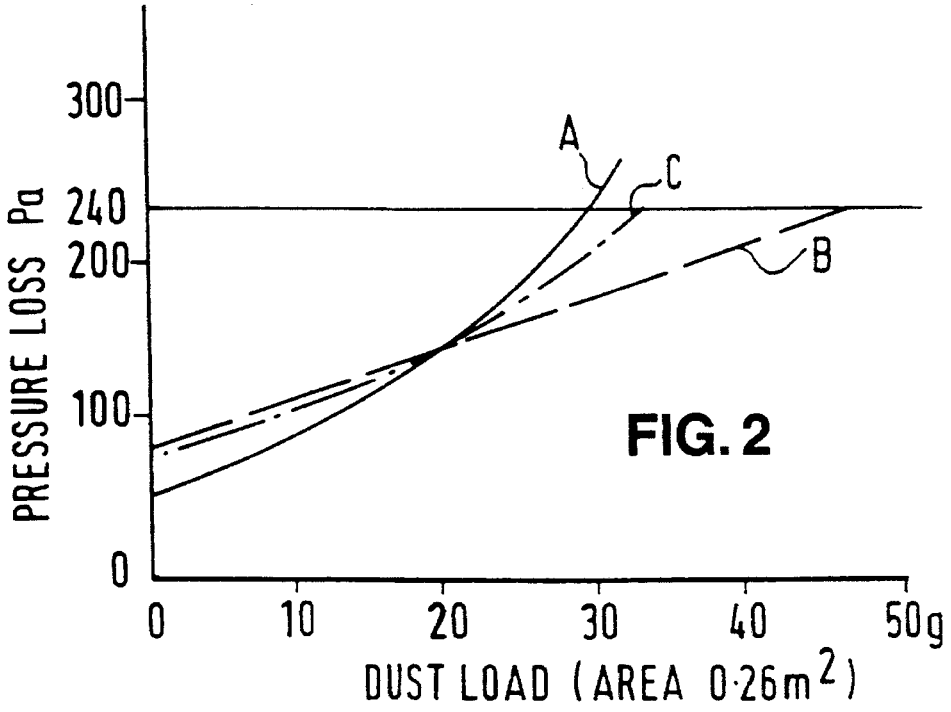
FIG. 2 shows the dust holding capacity for a final pressure difference of 240 PA.

In an evaluation, different filters were subjected to the ASHRAE test to measure efficiency. ASHRAE stands for "American Society of Heating Refrigeration and Air Conditioning Engineers." Equivalent tests are specified by BS 6540 and Eurovent No. 4/5. The results are shown in the drawings in which the results for the electrostatic filter material with a backing downstream of the dust flow are shown in curves labelled A; the results for the filter assembly prepared above, i.e., prefilter/electrostatic filter material backing, are shown in the curves labelled B; and the results for an arrangement in which electrostatic filter material is upstream of the prefilter/backing are shown in curves labelled C. Thus, the load of dust taken up by the different filters for an area of 0.26 $m^2$ under a velocity of 0.5 m/s was measured and the results are shown in the graph of FIG. 1 of the accompanying drawing. The dust holding capacity was also determined for a final pressure difference of 240 Pa, and the results are shown in the graph of FIG. 2. These results show that when the electrostatic filter material is used alone the dust load and holding capacity fall away relatively rapidly; when the prefilter medium is located downstream of the electrostatic filter material there is only slight improvement, but when the prefilter is present in accordance with the teachings of this invention there is a dramatic improvement in both properties.

In another example melt-blown fibres or other fine fibres were formed into a dense matrix and bonded to a spun media backing. On the melt-blown, or other fine fibre matrix the electrocet material then the pre-filter layer from the above example were laid. The layers are then needled, sewn or bonded together and formed into a filter, for example a bag, pad, or a pleated cassette.

In another example the polypropylene fibre and modacrylic fibre were not crimped, in contrast to the examples described above, to provide a denser matrix.

Without further elaboration, the foregoing will so fully illustrate my invention that others may, by applying current or future knowledge, adapt the same for use under various conditions or service.

What is claimed about the invention is:

1. Filter means for trapping airborne particles, the filter comprising a layer of filter material having electrostatic charge and a layer of filter medium without electrostatic charge, the filter material having electrostatic charge comprising one or more of the following blends: clean polyolefin fibers and clean fibers of an addition polymer comprising one or more halogen-substituted hydrocarbons; polypropylene and cellulose diacetate; polypropylene and stainless steel; polypropylene and cotton; polypropylene and silk; polypropylene and wool; nylon and polypropylene; and polypropylene and polyethylene; the medium being a lofted material arranged to retain particles including those in the sub-micron and lower micron ranges, and being located in use upstream of the material, whereby the upstream filter medium increases in efficiency with time to compensate for reduction in efficiency of the filter material and the filter has improved dust load and holding capacity.

2. Filter means according to claim 1, wherein the filter medium without electrostatic charge comprises polyester/polyamide/polypropylene or other fiber carded to form a fleece having no electrostatic charge and having a density of approximately 110–160 g/$m^2$.

3. Filter means according to claim 1, including a further layer of a filter medium without electrostatic charge located, in use, downstream of the material having the electrostatic charge.

4. Filter means according to claim 1, wherein the further layer comprises a dense matrix of melt-blown fibers or other fine fibers.

5. Filter means according to claim 4, wherein the matrix of melt-blown or other fine fibers is bonded to a spun media backing.

6. A method of filtering dust from a dust-containing atmosphere, the method comprising passing the atmosphere through a filter comprising a filter material having electrostatic charge and a filter medium without electrostatic charge; the filter material comprising one or more of the following blends: clean polyolefin fibers and clean fibers of an addition polymer comprising one or more halogen-substituted hydrocarbons; polypropylene and cellulose diacetate; polypropylene and stainless steel; polypropylene and cotton; polypropylene and silk; polypropylene and wool; nylon and polypropylene; and polypropylene and polyethylene; the medium being lofted and located upstream of the filter material and arranged to retain particles including those in the sub-micron and lower micron ranges and being arranged to increase in efficiency with time, to compensate for reduction in electrostatic properties of the electrostatically charged material whereby the filter has improved dust load and holding capacity.

7. A method according to claim 6, including passing the atmosphere through a further layer of filter medium without electrostatic charge, the further layer being downstream of the material having electrostatic charge.

* * * * *